US005860456A

United States Patent [19]

Bydlon et al.

[11] Patent Number: 5,860,456

[45] Date of Patent: Jan. 19, 1999

[54] SYRINGE ALIGNMENT DEVICE

[75] Inventors: Roland Joseph Bydlon, Indianapolis; Javan Eronmy Collins, Fishers; William Harold Morrison, Jr., Avon; Bradley Ray Newman, Plainfield, all of Ind.

[73] Assignee: Eli Lilly and Company, Indianapolis, Ind.

[21] Appl. No.: 622,241

[22] Filed: Mar. 22, 1996

Related U.S. Application Data

[60] Provisional application No. 60/009,200 Dec. 22, 1995 and provisional application No. 010,826 Jan. 30, 1996.

[51] Int. Cl.[6] ..... B65B 1/04

[52] U.S. Cl. ..... 141/25; 141/27; 141/329; 141/383; 604/905

[58] Field of Search ..... 141/25, 26, 27, 141/329, 383, 386; 604/905, 407, 414

[56] References Cited

U.S. PATENT DOCUMENTS

| | | | |
|---|---|---|---|
| 4,338,980 | 7/1982 | Schwebel et al. | 141/18 |
| 4,850,966 | 7/1989 | Grau et al. . | |
| 5,240,047 | 8/1993 | Hedges . | |
| 5,247,972 | 9/1993 | Tetreault | 141/27 |
| 5,292,318 | 3/1994 | Haber et al. | 141/27 |
| 5,308,341 | 5/1994 | Chanoch . | |
| 5,334,162 | 8/1994 | Harris . | |
| 5,377,725 | 1/1995 | Neff . | |

OTHER PUBLICATIONS

Scale Magnifier and Needle Guide for Insulin Syringes Sold by Becton Dickinson (No Available Date).

*Primary Examiner*—Henry J. Recla
*Assistant Examiner*—Steven O. Douglas
*Attorney, Agent, or Firm*—Michael T. Bates; David E. Boone

[57] ABSTRACT

A device for aligning a syringe with a vessel having a variable internal volume and containing an injectable solution. The device includes one section for removably retaining a vessel of an injectable solution, one section for allowing insertion and extraction of a syringe, and another section adjoining the two aforementioned sections for accurately aligning the needle of the syringe with the opening of the vessel. The alignment device further includes a clip for both releasably retaining the vessel in the device and for enabling the device to be clipped to a shirt pocket.

17 Claims, 1 Drawing Sheet

SYRINGE ALIGNMENT DEVICE

CROSS-REFERENCE TO RELATED APPLICATIONS

This application claims the benefit under Title 35, U.S.C. § 119 (e) of U.S. Provisional patent application Ser. No. 60/009,200, entitled SYRINGE ALIGNMENT DEVICE, filed on Dec. 22, 1995 and U.S. Provisional patent Application Ser. No. 60/010,826, entitled SYRINGE ALIGNMENT DEVICE, filed on Jan. 30, 1996.

BACKGROUND OF THE INVENTION

1. Field of the Invention

The present invention generally relates to devices for securely aligning a syringe with a vessel containing an injectable medication.

2. Description of the Related Art

The treatment of conditions requiring frequent injections of medications, such as insulin for the treatment of diabetes, has traditionally demanded that a user purchase vial of medication, often 10 ml in volume, draw a dosage from the vial using a syringe, and store the remaining medication in a refrigerated environment until a subsequent injection is needed.

Alternatively, a user can purchase a variable volume cartridge, typically 1.5–3.0 ml in volume, as disclosed in U.S. Pat. No. 5,334,162, assigned to the assignee of the present invention. Such cartridges typically contain only a few dosages, and are sold pre-enclosed in an injector pen which is disposed of after the medication is dispensed.

In certain locations throughout the world, both of the aforementioned alternatives present difficulties. In locations where access to refrigeration is scarce or simply unavailable, a 10 ml vial is not a viable option because medication remaining in the vial cannot be properly maintained. Moreover, the purchase of the larger, 10 ml vial, itself, is often beyond the economic means of the potential user.

Given the expense of vials, as well as the unavailability of adequate refrigeration in many locations, the less expensive and smaller variable volume cartridge is especially desirable. However, since such cartridges are typically sold encased in a disposable injector pen, the cost of the unit as a whole is often too great for many potential users.

Not only are vials relatively expensive and difficult to maintain, but vials also require a user to hold the vial in one hand and insert the needle of a syringe into the vial with the other hand during the dosing process. This procedure, while adequate for some, is subject to mistakes such as needle pricks or inaccurate dosages and is particularly a problem for patients having unsteady hands, persons who are visually impaired, or for children.

The prior art has attempted to address this problem by providing a tool which guides the syringe needle directly into the opening of the vial. For example, U.S. Pat. No. 5,240,047, issued to Hedges, discloses a one-piece needle guide and bottle holding device in which one channel of the device is adapted to receive a portion of the bottle or vial such that the opening of the vial is exposed to the needle guide channel.

While a device such as Hedges is adequate for aligning a syringe with a vial, variable volume cartridges are much smaller and differently shaped than vials, and therefore the Hedges design will not function with variable volume cartridges. The aforementioned U.S. Pat. No. 5,334,162 does disclose a device which can be attached to a variable volume cartridge and receive a syringe therein, but the device is designed for injecting fluid into a cartridge, and not inexpensively and accurately aligning a syringe with a cartridge for subsequent extraction of fluid from the cartridge.

SUMMARY OF THE INVENTION

The present invention is a syringe and variable volume vessel alignment device which solves the above-identified needs by providing an inexpensive, safe, and accurate design for aligning a syringe, such as a U100 model manufactured by Becton Dickinson, with a vessel having a variable internal volume, such as the 1.5 m1 and 3.0 ml cartridges manufactured by Eli Lilly and Company.

The alignment device disclosed by the present invention includes integral cartridge, needle, and syringe sections. The cartridge section has a generally cylindrical shape, having an opening which leads to a cylindrical chamber approximately the size of the intended cartridge. The cartridge section is provided with a positive stop to maintain the cartridge in its appropriate position and a releasable clip to hold the cartridge in place until it is desired to have the cartridge extracted.

The needle section has a generally conical outer shape with a tapered inner chamber leading from the positive stop of the cartridge section to the syringe section. The larger end of the inner chamber engages the neck flange of the cartridge while the smaller end of the inner chamber, in conjunction with the syringe section, holds the head of the syringe in place. The design of a suitable variable volume cartridge is provided in the aforementioned U.S. Pat. No. 5,334,162, the disclosure of which is expressly incorporated by reference herein. The needle of the syringe is then able to accurately align with and puncture the disk seal of the cartridge.

The syringe section has a generally cylindrical outer surface with an inner cylindrical chamber approximately the diameter of the syringe to be inserted. The syringe section is provided with a positive stop which contacts a collar provided on the syringe to prevent the syringe from passing its appropriate position. The syringe section is also provided with an annular flange to protect the user from accidental needle pricks. Once the syringe is inserted into the alignment device and the needle of the syringe punctures the disk seal of the cartridge, the plunger of the syringe can be drawn away from the syringe to draw the liquid medication from within the cartridge and into the syringe. The syringe can then be extracted from the alignment device for insertion into the patient. The cartridge can be either retained in the device or can be removed from the alignment device by pressing the clip on the outside of the cartridge section to thereby free the cartridge and allow its removal.

One advantage of the present invention is that the present invention can be produced at a relatively low cost, and therefore provide an inexpensive means of aligning a syringe with a variable volume cartridge and eliminate the need to purchase and refrigerate a large volume vial, or purchase an injector pen.

Another advantage of the present invention is that it provides a relatively easy means for aligning a syringe with a cartridge containing medication which minimizes the risk of needle pricks. This is a particular advantage for users with unstable hands, for users with poor eyesight, or for children.

Another advantage of the present invention is that the positive stops provided within the device prevent the syringe and the cartridge from being inserted to an incorrect position and thereby interfering with the movement of the cartridge piston. The entire volume of medication within the cartridge can therefore be extracted.

Another advantage of the present invention is that the cartridge is maintained in its proper position and can be easily released by pushing on the release clip.

Another advantage of the present invention is that the cartridge can be retained in the alignment device and stored for subsequent uses.

The present invention, in one form, provides a device for aligning a syringe with a vessel to enable accurate insertion of the syringe into the vessel. The syringe includes a fluid medication chamber, a plunger reciprocatingly disposed within the medication chamber, and a needle in fluid communication with the medication chamber. The vessel has a variable internal volume and contains injectable fluid. The device includes an alignment housing having a vessel chamber coaxial with a syringe chamber wherein the vessel chamber and the syringe chamber are adapted to receive the vessel and the syringe, respectively. The housing further includes a vessel stop and a syringe stop. The vessel engages the vessel stop, the syringe engages the syringe stop, the syringe is coaxial with the vessel, and the needle penetrates the vessel a predetermined distance, when the syringe and the vessel are received in the housing.

The present invention, in another form thereof, provides an injection preparation system comprising a syringe, a cartridge, and an alignment housing. The syringe includes a chamber for containing fluid medication, a plunger reciprocatingly disposed within the medication chamber, and a needle in fluid communication with the medication chamber. The cartridge includes an elastomeric piston slidably disposed within the cartridge, an exit having a penetrable membrane, and an injectable fluid contained between the exit and the elastomeric piston. Finally, the alignment housing includes a cartridge chamber coaxial with a syringe chamber wherein the cartridge chamber and the syringe chamber are adapted to receive the cartridge and the syringe, respectively. The housing further includes a cartridge stopping means and a syringe stopping means. The cartridge engages the cartridge stopping means, the syringe engages the syringe stopping means, the syringe is coaxial with the cartridge, and the needle punctures the membrane and penetrates the cartridge a predetermined distance short of the piston, when the syringe and the cartridge are received in the housing.

The present invention, in yet another form thereof, provides a syringe alignment device for releasably retaining a vessel having a variable internal volume and containing an injectable fluid. A vessel chamber including an insertion opening is disposed within the device and is adapted to receive the vessel. A syringe chamber is also disposed within the device and is adapted to receive the syringe. The syringe chamber further includes an insertion opening through which a syringe needle passes to penetrate the insertion opening of the vessel chamber and the vessel itself. The device further includes an elastically deformable clip attached to the alignment housing which includes a cleat inwardly extending into the vessel chamber. The cleat engages and releasably retains the vessel when the vessel is received into the vessel chamber.

The present invention, in yet another form thereof, provides a method for aligning a syringe with a vessel and setting a dosage within the syringe. The vessel has a variable internal volume and contains an injectable fluid, and the syringe includes a chamber for containing fluid medication, a plunger reciprocating disposed within the medication chamber, and a needle in fluid communication with the medication chamber. The method comprises the steps of telescopingly inserting the vessel into a vessel chamber of an alignment housing, telescopingly inserting the syringe into a syringe chamber of the alignment housing, and withdrawing a plunger disposed within the syringe to thereby draw injectable fluid into the syringe. When the vessel and the syringe are inserted into the housing, the vessel is coaxial with the syringe and a needle of the syringe penetrates the vessel.

BRIEF DESCRIPTION OF THE DRAWINGS

The above-mentioned and other features and objects of this invention, and the manner of attaining them, will become more apparent and the invention itself will be better understood by reference to the following description taken in conjunction with the accompanying drawings, wherein.

Corresponding reference characters indicate corresponding parts throughout the several views. The exemplification set out herein illustrates one embodiment of the invention and such exemplification is not to be construed as limiting the scope of the invention in any manner.

DETAILED DESCRIPTION OF THE PRESENT INVENTION

The embodiment disclosed below is not intended to be exhaustive or limit the invention to the precise form disclosed in the following detailed description.

Figure 1:
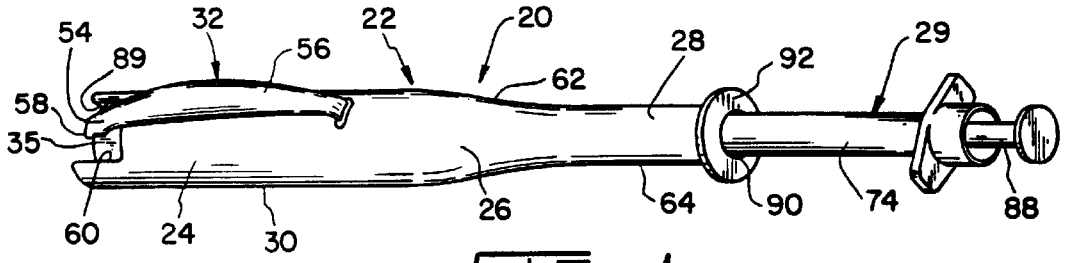
FIG. 1 is a perspective view of the present invention with a syringe inserted therein for extraction of medical solution from a cartridge also contained within the present invention.

Referring now to FIG. 1, alignment device 20 is shown having housing 22 which includes integral cartridge section 24, needle section 26, and syringe section 28. In the exemplary embodiment, housing 22 is manufactured from transparent polystyrene plastic, although other materials are certainly possible. Syringe 29 is shown inserted into alignment device 20. Polystyrene not only provides a clear material from which to manufacture housing 22, but also, in conjunction with the cylindrical shape of housing 22, provides a magnifying effect to the dosage graduations (not shown) printed on syringe 29 to assist the user in setting a dose.

Figure 4:
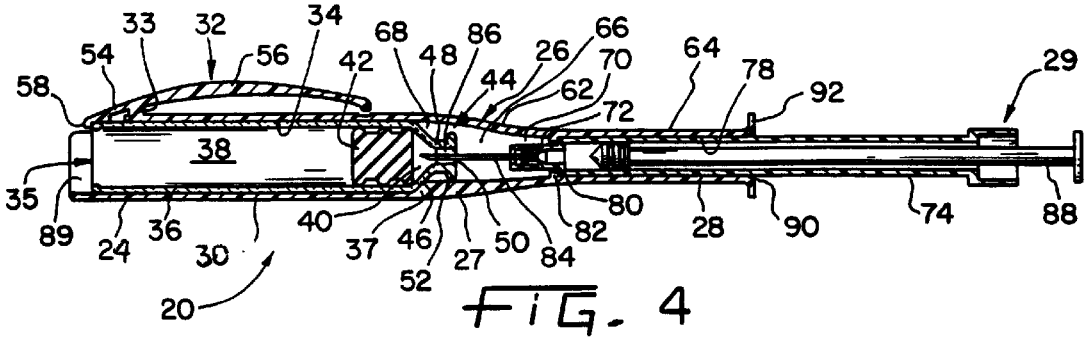
FIG. 4 is a sectional view of the present invention taken along the line 4—4 of FIG. 2.

As best shown in FIGS. 1 and 4, cartridge section 24 has a generally cylindrical outer surface 30 with a resilient plastic clip 32 integrally attached via attaching arm 33. Cartridge section 24 also includes inner cylindrical chamber 34 having a diameter roughly equivalent to the diameter of cartridge 35 as best shown in FIG. 4. Cartridge 35, as disclosed in U.S. Pat. No. 5,334,162, is comprised of a tubular portion 36 defining an inner chamber 38 containing medication solution 40. A cartridge piston 42 is axially movable within cartridge 35 and is shown in FIG. 4 positioned adjacent dispensing end 44 of cartridge 35. Dispensing end 44 of cartridge 35 includes inwardly sloping shoulder 46, reduced diameter neck 48, and exit 50 having circumferential flange 52. The diameter of neck flange 52 is greater than the diameter of neck 48. In other embodiments of the present invention, a collapsible tube, or other vessels having a variable internal volume, may be used in lieu of cartridge 35.

Figure 2:
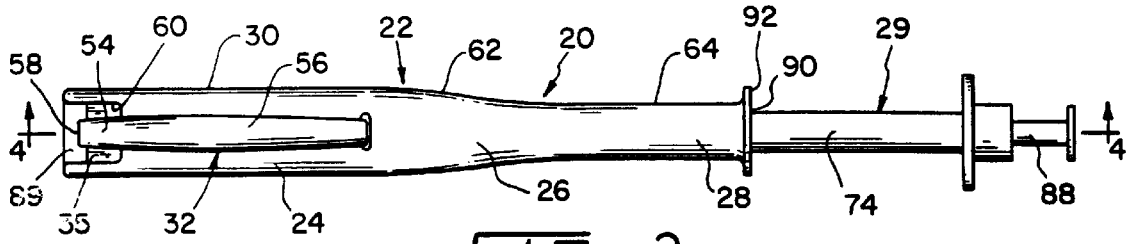
FIG. 2 is a side elevation view of the embodiment shown in FIG. 1.

Cartridge 35 is manually pushed into cartridge section 24 until cartridge shoulder 46 comes into contact with cartridge stop 37 of section 24. As cartridge 35 is inserted, retaining portion 54 of clip 32 is forced outward and actuating portion 56 of clip 32 is thereby forced inward and against the cylindrical outer surface 30 of cartridge section 24. Once cartridge 35 is fully inserted into cartridge section 24, retaining cleat 58, which is provided on the end of retaining portion 54, is no longer held outward by cartridge 35 and therefore snaps inward and retains cartridge 35 within alignment device 20. Clip 32 is also designed to be used as a convenient means for retaining alignment device 20 within a shirt or jacket pocket, for example. To allow for the inward and outward motion of retaining cleat 58, and to allow for a user to withdraw cartridge 35 from alignment device 20, cartridge section 24 is provided with window 60 having, in the exemplary embodiment, a generally rectangular shape as best shown in FIG. 2.

Needle section 26 is shown having a generally conical outer surface 62 which tapers from the generally cylindrical outer surface 30 of cartridge section 24 to the generally cylindrical outer surface 64 of syringe section 28. As best shown in FIG. 4, the inner area of needle section 26 is provided with tapered chamber 66. Tapered chamber 66 narrows from large diameter end 68 to small diameter end 70. As best shown in FIG. 4, wall 27 of needle section 26 decreases in thickness from cartridge stop 37 to syringe stop 82.

Syringe section 28 is comprised of a generally cylindrical outer surface 64 and a cylindrical inner surface 78 having a diameter roughly equivalent to the outer diameter of syringe body 74. Therefore, as shown in FIG. 4, when syringe 29 is inserted into alignment device 20, syringe body 74 occupies syringe section 28 and contacts inner surface 78. Since syringe head 72 has a smaller diameter than syringe body 74, syringe 29 can be inserted into alignment device 20 until shoulder 80 of syringe 29 contacts syringe stop 82 of syringe section 28. In doing so, needle 84 is able to penetrate disk seal 86 of cartridge 35 and thereby access medication solution 40 within tubular portion 36 of cartridge 35. Once syringe plunger 88 is drawn back within syringe body 74, solution 40 enters syringe 29 through needle 84 and the vacuum thereby created pulls cartridge piston 42 toward needle 84.

Syringe section 28 is also provided with an annular flange 92 about the outer circumference of syringe opening 90. Annular flange 92 is provided as a protective shield to prevent needle 84 from puncturing the user's hand, and as a needle guide which funnels needle 84 into syringe opening 90.

Figure 3:
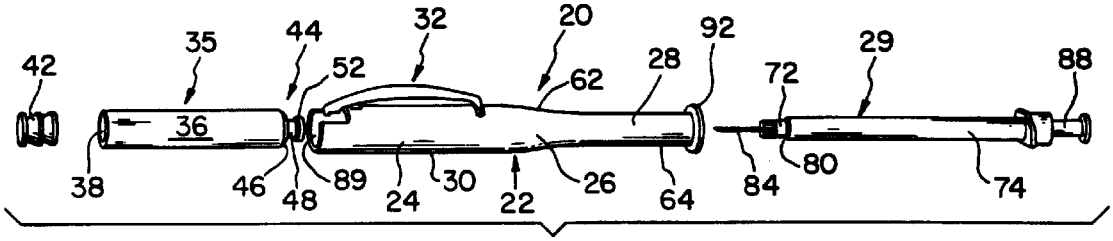
FIG. 3 is an exploded view of the embodiment shown in FIG. 1.

In operation, cartridge 35 is inserted into alignment device 20 through cartridge opening 89 of cartridge section 24 as best shown in FIG. 3. This motion forces retaining cleat 58 outward to allow passage of cartridge 35 until cartridge shoulder 46 comes into contact with cartridge stop 37, which in turn enables retaining cleat 58 to snap inward through clip window 60 and thereby hold cartridge 35 within alignment device 20.

Syringe 29 can then be inserted into syringe opening 90 of alignment device 20 until syringe shoulder 80 comes into contact with syringe stop 82. In so doing, needle 84 will accurately penetrate cartridge disk seal 86 and access medical solution 40. Since cartridge section 24 is coaxial with syringe section 28, and the diameters of cartridge 35 and syringe 29 are roughly equivalent to the respective inner diameters of cartridge section 24 and syringe section 28, syringe 29 will be aligned with cartridge 35. Moreover, syringe 29 is appropriately positioned to allow needle 84 to penetrate disk seal 86, but not penetrate cartridge 35 to a point where needle 84 will interfere with the movement of piston 42.

When the user wishes to extract medication solution 40, syringe plunger 88 is pulled away from syringe body 74 to draw solution 40 into syringe 29. As plunger 88 is pulled away from syringe 29, piston 42 moves toward syringe 29 as a result of the vacuum thereby created. This is beneficial in that ambient air therefore cannot enter cartridge 35 to potentially contaminate medication 40 remaining in cartridge 35. Given the magnifying effect produced by transparent polystyrene housing 22, a user can easily identify the dosage being set within syringe 29.

Syringe 29 can then be extracted from alignment device 20 for injection of medication 40. Cartridge 35 can be removed from alignment device 20 by pushing actuating portion 56 of clip 32 inward against cartridge section 24 to thereby force retaining cleat 58 outward to allow cartridge 35 to be removed from alignment device 20. The user can grasp cartridge 35 through clip window 60 during extraction.

While this invention has been described as having a particular design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for aligning a syringe with a vessel, the syringe including a chamber for containing fluid medication therein, a plunger recipirocatinaly disposed within the medication chamber, and a needle in fluid communication with the medication chamber, the vessel having a variable internal volume and containing injectable fluid, said device comprising:

an alignment housing including a vessel chamber coaxial with a syringe chamber, said vessel chamber adapted to receive the vessel, said syringe chamber adapted to receive the syringe, said housing further including a vessel stop for limiting axial movement of the vessel when the vessel is received in said vessel chamber, and a syringe stop for limiting axial movement of the syringe when the syringe is received in said syringe chamber, the vessel being coaxial with the syringe, the syringe engaging said syringe stop, the vessel engaging said vessel stop, and the needle penetrating the vessel a predetermined distance, when the syringe and the vessel are received in said housing, wherein said housing further includes an elastically deformable tab which flexes away from said housing to allow the vessel to be inserted and removed, and wherein said tab is biased toward said housing to retain the vessel in said housing.

2. The device of claim 1, wherein said tab is a clip attached to said housing which also provides a convenient means for storing said device in a shirt pocket.

3. The device of claim 1, wherein said vessel chamber includes a window through which said elastically deformable clip extends to engage and releasably lock the vessel within said housing.

4. The device of claim 1, wherein said housing includes a syringe end and a vessel end, the vessel being telescopingly receivable into said vessel end and the syringe being telescopingly receivable into said syringe end.

5. The device of claim 4, wherein said syringe end further includes an annular flange to protect a user of said device from being inadvertently stuck with the syringe during insertion of the syringe into said housing.

6. An injection preparation system, comprising:

a syringe having a chamber for containing fluid medication therein, a plunger reciprocatingly disposed within said medication chamber, and a needle in fluid communication with said medication chamber;

a cartridge having an elastomeric piston slidably disposed therein, an exit, and an injectable fluid contained therebetween, said exit further including a penetrable membrane; and an alignment housing including a cartridge chamber coaxial with a syringe chamber, said cartridge chamber adapted to receive said cartridge, said syringe chamber adapted to receive said syringe, said housing further including means for stopping said cartridge when said cartridge is received in said cartridge chamber, and means for stopping said syringe when said syringe is received in said syringe chamber, said cartridge being coaxial with said syringe, said syringe engaging said syringe stopping means, said cartridge engaging said cartridge stopping means, and said needle puncturing said membrane and penetrating said cartridge a predetermined distance short of said piston, when said syringe and said cartridge are received in said housing, wherein said housing further includes an elastically deformable tab which flexes away from said housing to allow said cartridge to be inserted and removed, and wherein said tab is biased toward said housing to retain said cartridge in said housing.

7. The system of claim 6, wherein said tab is a clip attached to said housing which also provides a convenient means for storing said device in a shirt pocket.

8. The system of claim 6, wherein said cartridge chamber includes a window through which said elastically deformable clip extends to engage and releasably lock said cartridge within said housing.

9. A syringe alignment device for releasably retaining a vessel having a variable internal volume and containing an injectable fluid, said device comprising:

a vessel chamber disposed within said device and having an insertion opening, said vessel chamber adapted to receive the vessel;

a syringe chamber disposed within said device and coaxial with said vessel chamber, said vessel adapted to receive the syringe, said syringe chamber including an insertion opening through which a syringe needle passes to penetrate said vessel chamber insertion opening and the vessel;

an elastically deformable clip attached to the alignment housing, said clip having a cleat inwardly extending into said vessel chamber, said cleat engaging and releasably retaining the vessel when the vessel is received into said vessel chamber.

10. The device of claim 9, wherein said clip further includes an actuating portion, said clip being attached to the alignment housing via an attaching arm disposed between said cleat and said actuating portion, said cleat being forced away from said vessel chamber and releasing the vessel when said actuating portion is depressed toward said device, said attaching arm acting as a fulcrum between said cleat and said actuating portion.

11. The device of claim 9, wherein said device further includes a window through which said cleat extends to engage and releasably retain the vessel.

12. The device of claim 9, wherein said clip also provides a convenient means for storing said device in a shirt pocket.

13. The device of claim 9, wherein said device further includes a interior shoulder which limits linear movement of the vessel as the vessel is inserted into said vessel chamber, the vessel being releasably retained between said cleat and said interior shoulder when inserted into said vessel chamber.

14. The device of claim 9, wherein the vessel is variable volume cartridge having an elastomeric piston slidably disposed therein, an exit, an injectable fluid therebetween, and a maximum volume of 5 milliliters.

15. A method for aligning a syringe with a vessel and drawing fluid into the syringe, the syringe having a chamber for containing fluid medication, a plunger reciprocatingly disposed within said medication chamber, and a needle in fluid communication with said medication chamber, the vessel having an open end, a cylindrical envelope, and an opposite capped end, the opposite capped end comprising a restricted diameter end sealed by a pierceable material to receive a needle therethrough and a piston sized to be received in and seal the open end and to be telescopically movable within the cylindrical envelope, the method comprising the steps of:

telescopingly inserting the vessel into a vessel chamber of an alignment housing;

telescopingly inserting the syringe into a syringe chamber of the alignment housing until the needle pierces the pierceable material and extends into the restricted diameter end of the vessel and not into the cylindrical envelope; and withdrawing the plunger from the syringe medication chamber whereby the injectable fluid is drawn into the medication chamber.

16. A method for aligning a syringe with a vessel in an alignment housing and drawing fluid from the vessel into the syringe, the syringe having a chamber for receiving fluid medication, a plunger reciprocatingly disposed within said medication chamber, and a needle in fluid communication with said medication chamber, the vessel having a variable internal volume and containing fluid medication, the alignment housing including an elastically deformable clip and a vessel stop, the method comprising the steps of:

telescopingly inserting the vessel into the vessel chamber until the vessel is held in a fixed position between the vessel stop and the clip;

telescopingly inserting the syringe into a syringe chamber of the alignment housing, the vessel being coaxial with the syringe and the needle penetrating the vessel; and withdrawing the plunger from the syringe medication chamber whereby the injectable fluid is drawn into the medication chamber.

17. The method of claim 16, wherein the alignment housing further includes a syringe stop, said method further including the step of:

telescopingly inserting the syringe into the syringe chamber until the syringe engages the syringe stop, the syringe being prevented from further axial movement and penetrating the vessel a predetermined distance.

* * * * *